United States Patent [19]

Porter

[11] 4,335,636

[45] Jun. 22, 1982

[54] APPARATUS FOR CUTTING A MOVING SHEET

[75] Inventor: Michael J. Porter, Hanover Park, Ill.

[73] Assignee: United States Gypsum Company, Chicago, Ill.

[21] Appl. No.: 192,160

[22] Filed: Sep. 29, 1980

[51] Int. Cl.[3] ..... B26F 3/00

[52] U.S. Cl. ..... 83/177; 83/284; 83/353; 83/578

[58] Field of Search ..... 83/177, 578, 53, 353, 83/284, 486.1, 487, 488

[56] References Cited

U.S. PATENT DOCUMENTS

| | | | |
|---|---|---|---|
| 3,262,419 | 7/1966 | Knight | 83/284 X |
| 3,485,128 | 12/1969 | Siegenthaler | 83/353 X |
| 3,524,367 | 8/1970 | Franz | 83/53 |
| 3,532,014 | 10/1970 | Franz | 83/53 |
| 3,557,651 | 1/1971 | Byrley | 83/303 |
| 3,891,157 | 6/1975 | Justus | 83/53 X |
| 3,978,748 | 9/1976 | Leslie et al. | 83/177 X |
| 4,048,885 | 9/1977 | Miyakita et al. | 83/578 X |
| 4,137,804 | 2/1979 | Gerber et al. | 83/177 |
| 4,140,038 | 2/1979 | Higgins | 83/177 |

FOREIGN PATENT DOCUMENTS

| | | | |
|---|---|---|---|
| 184364 | 1/1956 | Fed. Rep. of Germany | 83/53 |

OTHER PUBLICATIONS

Waternife Shape Cutting Systems, Contact Flow Industries, Inc., Equipment Bulletin, No. 5/78.

Fluid Jets . . . a Cut Above the Rest, Compressed Air Magazine, Feb. 1977, pp. 10–14.

Water-Jet Machining, Machine Design, Feb 22, 1973, pp. 89–93.

*Primary Examiner*—Frank T. Yost

*Attorney, Agent, or Firm*—Samuel Kurlandsky; Robert H. Robinson; Kenneth E. Roberts

[57] ABSTRACT

An apparatus for cutting a newly formed continuous sheet being transported longitudinally along a belt conveyor, and particularly a newly formed gypsum board sheet, the cutting taking place in a direction transverse to the direction of movement of the sheet, comprising a frame, a high pressure fluid jet cutter mounted to move obliquely with respect to the direction of the moving sheet, wherein the vector component of velocity of the forward motion of the cutter equals the forward velocity of the moving sheet, and means for rotating the support on which the jet cutter is mounted to another oblique position so that a successive cut may be made from the other side. In an improved embodiment, tank means is arranged to catch the spent fluid from the jet cutter so that the cutter may traverse the moving sheet from either side successively without turning off the fluid jet.

4 Claims, 3 Drawing Figures

APPARATUS FOR CUTTING A MOVING SHEET

BACKGROUND OF THE INVENTION (1) Field of the Invention

The present invention relates to apparatus for transversely cutting a moving sheet, and more particularly refers to a means for cutting a newly formed gypsum board sheet.

(2) Description of the Prior Art

In the production of gypsum board for dry wall use, an aqueous slurry of calcined gypsum containing various conventional additives is deposited between two paper cover sheets and transported on a conveyor until the gypsum slurry becomes almost completely hydrated or set. Conventionally, rotary matching knives are then utilized to cut the moving board transversely into individual boards. The gypsum sheet must be cut when the slurry becomes hard and reaches or almost reaches the point of final set. If knives are used to cut the gypsum sheet while the gypsum is still somewhat soft, a mashing of the material results and the boards must be scrapped.

Recently an apparatus has been developed which utilizes a liquid jet stream produced under extremely high pressure. The jet stream produces a clean, dust-free cut on gypsum board and operates under acceptable noise levels.

The necessity for delaying the conventional cutting of the gypsum board sheet until a final set has substantially been attained is a limiting factor in the speed of the production run. Either extremely long tables or conveyors must be utilized to provide adequate time for setting, or, alternatively, the speed of the line must be reduced to provide sufficient dwell time on the conveyor for setting of the gypsum. It would be desirable to be able to speed up the production line without increasing the length of the conveyor or reducing the speed of the line, while still obtaining a clean transverse cut of the gypsum board.

SUMMARY OF THE INVENTION

It is therefore an object of the present invention to provide an apparatus for transversely cutting a moving strip of newly formed gypsum board which provides a clean cut.

It is further an object to provide an apparatus of the type described which can be utilized to cut newly formed gypsum board shortly after the initial set has taken place and considerably before the final set has been achieved, so that the line may be substantially speeded up.

It is still further an object to provide an apparatus for cutting gypsum board where the moving board may alternately be cut from the left side and the right side without the need for turning off the high pressure water jet used for cutting between each cut.

It is a further object of the invention to provide an apparatus of the type described which is relatively inexpensive to produce and is fast and reliable in operation.

These and other objects, advantages and functions of the invention will be apparent upon reference to the specification and to the attached drawings illustrating preferred embodiments of the invention, in which like parts are identified by like reference symbols in each of the views.

According to the invention, an apparatus for transversely cutting a moving sheet of material is provided which comprises a carrier in the form of a center-pivoted beam disposed at an angle with respect to the longitudinal direction of motion of the moving sheet in each of two alternate positions and mounted above the moving sheet. A screw driven by a motor is mounted on the beam and journaled in bearings. A threaded block is mounted on the screw and has a high pressure fluid jet cutter nozzle affixed thereto. The screw is driven at such a speed diagonally across the gypsum board that the longitudinal vector component of speed of the jet nozzle is equal to that of the moving sheet. Consequently, as the jet cutter nozzle moves along the screw, it ejects a fluid which cuts the sheet with a cut which is perfectly perpendicular to the edges of the sheet. When the nozzle reaches its terminal point, the beam is rotated by means of an air cylinder to a position at an opposite angle with respect to the original position of the beam. The motor driving the screw is then reversed and the jet traverses the moving sheet in an opposite direction, this time providing a perpendicular cut across the sheet in the opposite direction. A tank is provided for receiving spent fluid which is ejected from the nozzle at all of its positions, so that the nozzle need not be turned off when changing from one direction to the other.

DESCRIPTION OF THE PREFERRED EMBODIMENT

Figure 1:
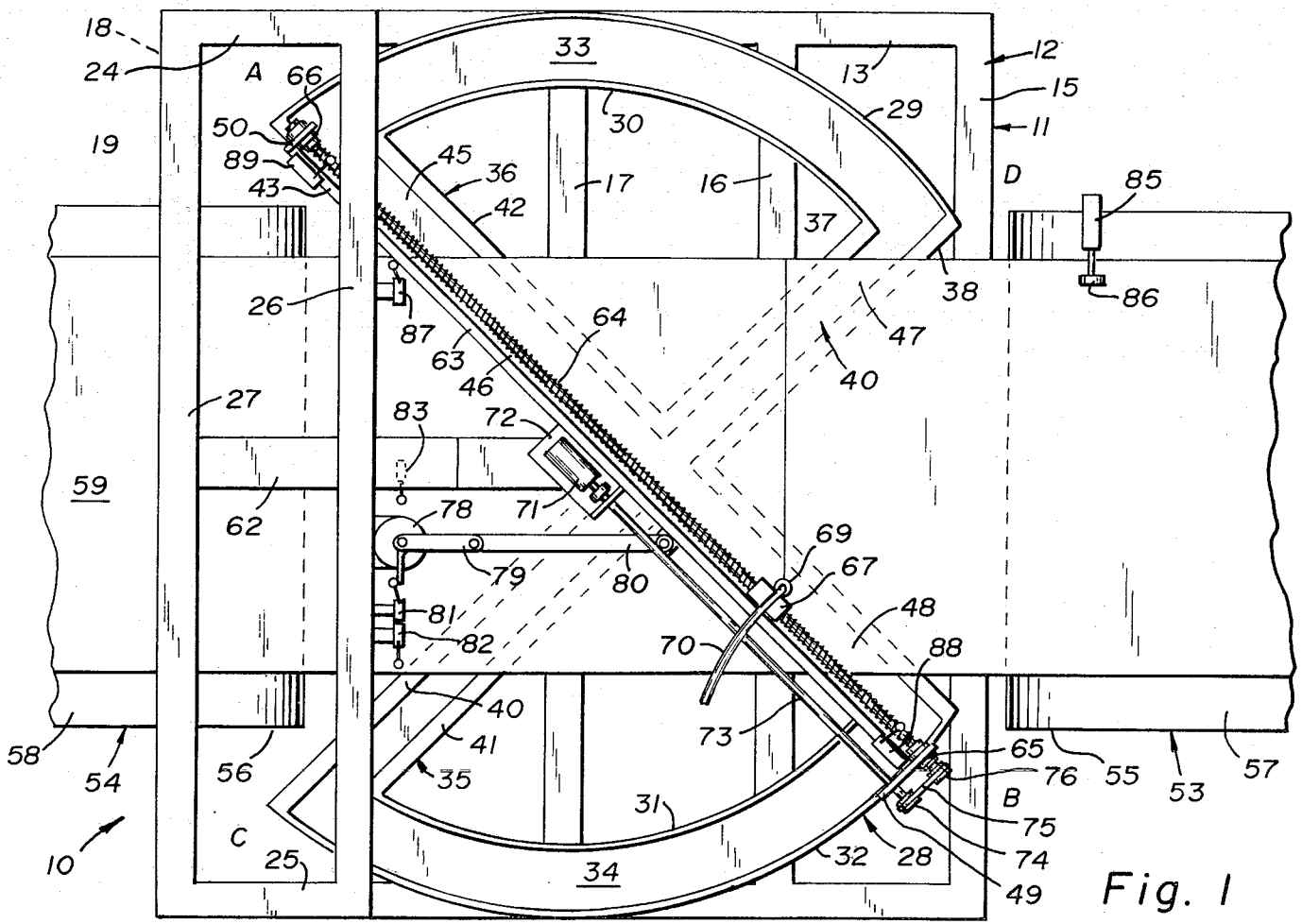
FIG. 1 is a top view of an apparatus according to the invention.
Figure 2:
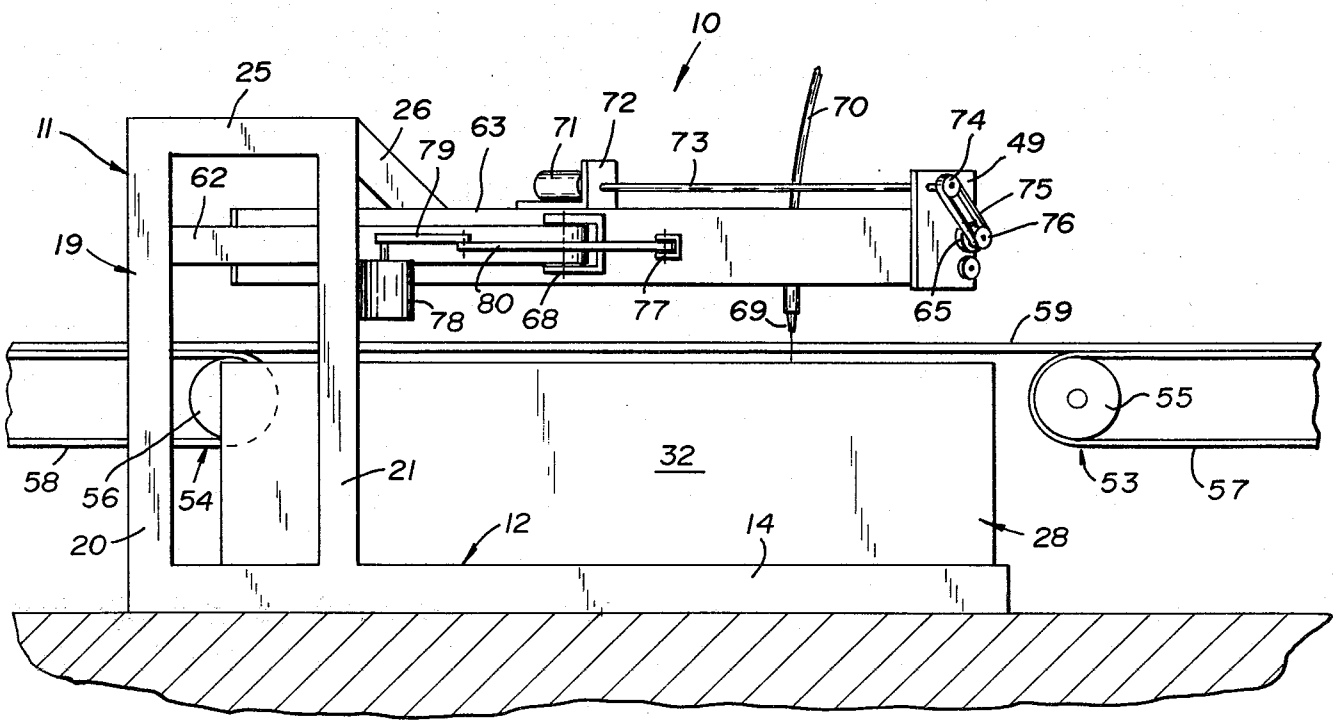
FIG. 2 is a side elevational view of the apparatus of FIG. 1.
Figure 3:
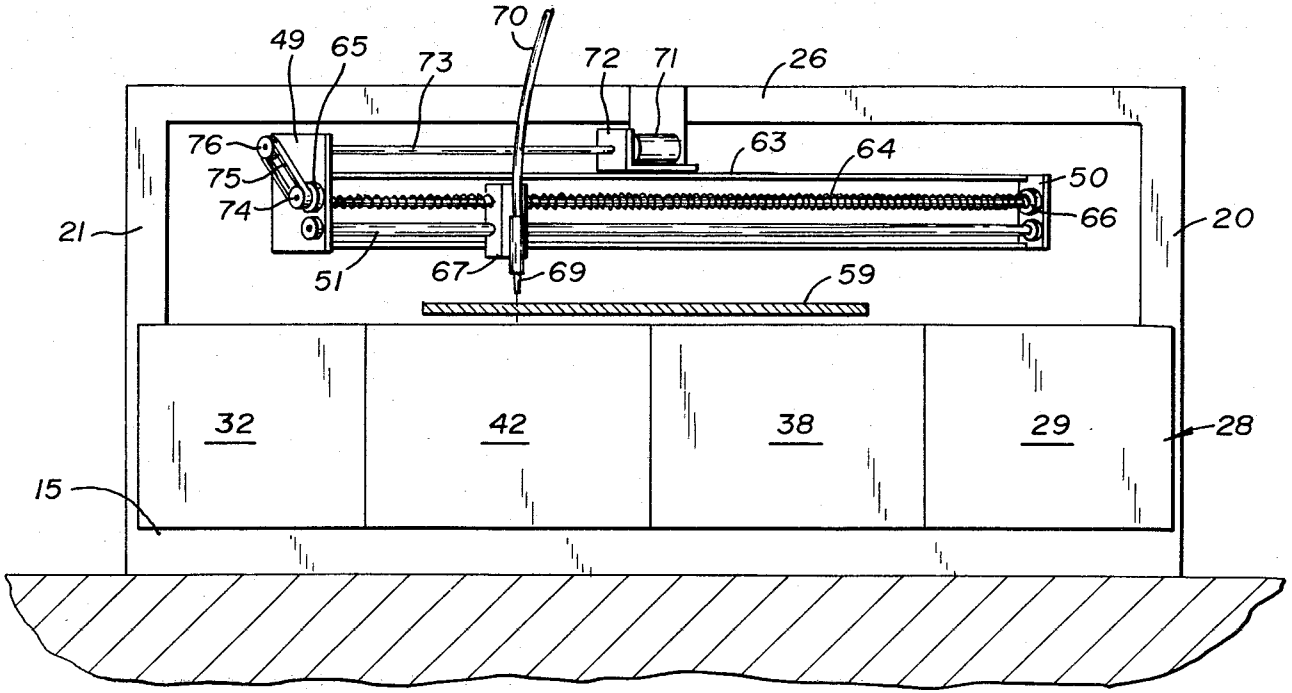
FIG. 3 is an end elevational view of the apparatus shown in FIGS. 1 and 2.

Referring to FIGS. 1–3, an apparatus according to the invention is shown comprising a sheet cutting machine 10 having a frame 11 comprising a base frame 12 having longitudinal base members 13 and 14 and transverse base members 15, 16, 17 and 18. A vertical structure 19 comprises vertical frame members 20 and 21, on each side of the frame longitudinal frame members 24 and 25, and transverse frame members 26 and 27.

Mounted on the frame is a figure-eight shaped tank 28 comprising arcuate walls 29, 30, 31 and 32, bottom members 33 and 34, and diagonal troughs 35 and 36. The trough 35 comprises walls 37 and 38, the edges of the walls 37 and 38 defining a slot 40. The trough 36 has vertical walls 42 and 43, defining a slot 45. The troughs 35 and 36 are provided with bottom plates 47 and 48 to complete the figure-eight-shaped tank.

Associated with the apparatus described above are roll conveyors 53 and 54 having rotatably mounted rolls 55 and 56, respectively, mounted thereon. Conveyor belts 57 and 58 are mounted over the rolls 55 and 56 at one end and over similar rolls (not shown) at the other end. A newly formed gypsum board sheet 59 is shown being conveyed by the roll conveyors through the cutting apparatus.

As shown in FIGS. 1 and 2, a beam support 62 is mounted on the frame 19. A beam 63 in the form of a channel is pivotally mounted on the support 62 by means of a bearing pivot assembly 68. A threaded rod 64 is rotatably mounted by means of bearings 65 and 66 on mounting plates 49 and 50, respectively, which plates are mounted at the ends of the beam 63. A guide rod 51 (FIG. 3) is also affixed at its ends to the mounting plates 49 and 50.

A high pressure fluid jet cutter 69 is affixed to the ball bearing nut 67 which is threadedly engaged on the threaded rod 64 and slidably engaged over the guide rod 51. A flexible supply tube 70 conveys a fluid such as water under high pressure to the fluid jet cutter 69. Reciprocal traverse of the ball bearing nut 67 and fluid jet cutter 69 is accomplished by the rotation of the threaded rod 64. Rotation of the threaded rod is provided by means of a DC motor 71 mounted on a bracket 72 which in turn is mounted on the beam 63. A shaft 73 is connected to the motor and drives a pully 74 which is connected by means of an endless belt 75 to a pulley 76 mounted on one end of the threaded rod 64.

As shown in FIGS. 1 and 2, limited rotation of the beam 63 is accomplished by means of a crank motor 78 mounted on the frame 11 having a crank shaft 79 connected at its end to a connecting rod 80. Electrical control of rotation of the beam 63 is accomplished by means of limit switches 81, 82, 87, 88 and 89. A tach-generator 85 is mounted on the conveyor apparatus and has a wheel 86 which rides on the moving gypsum board sheet 59 to monitor the speed of the sheet. Information from the tach-generator 85 controls the speed of rotation of the threaded rod 64. A drain 91 is provided to drain spent liquid and gypsum dust from the tank 28.

The present invention is particularly useful for cutting newly-formed gypsum board which is deposited on the conveyor. As it moves along the conveyor, the board is cut by means of the high pressure fluid jet stream. The cut board continues further until it becomes fully set and is transported to a kiln where the board is completely dried. In conventional cutting apparatus knives are used for cutting the gypsum board. However, when knives are used, the cutting process must take place preferably after or near the point when the gypsum has been fully set. Cutting may take place a very short time before complete set is obtained. However, if the apparatus with cutting knives is utilized at a point substantially before the setting point has been reached, the blades chew up the gypsum board and render it unsuitable for use. It has been found that when a high pressure fluid jet stream is used for cutting gypsum board, cutting may take place considerably before the setting point has been reached. Consequently, the line may be speeded up and this results in a large saving in space and time.

In order to cut gypsum board which is moving along a conveyor in a longitudinal direction, it is necessary that as the cutting apparatus traverses the moving board, the apparatus have a speed movement component in the longitudinal direction equal to the speed of the moving board. This is accomplished in the present apparatus by having the fluid jet cutter mounted and transported by a rotating screw or threaded rod. The rod is positioned in a direction substantially at 45° with respect to the direction of movement of the gypsum board. The speed of rotation of the threaded rod is controlled so that as the jet cutter travels across the moving board, it has a conponent of motion in the longitudinal direction equal to the speed of the moving board. As a result a cut is made which is perfectly perpendicular with respect to the direction of movement and results in a cut which is clean and straight. After a cut is made in one direction, the crank motor 78 causes the beam to pivot or rotate about the pivot assembly 68 until the structure assumes a position at an angle of 90° with respect to its former position. The motor 71 which causes the threaded rod to rotate is now reversed and the fluid jet cutter is caused to move across the board in the other direction, but still with a forward component of motion equal to the speed of the moving board. The speed of the cutter is in fact 1.41 times as fast as the movement of the board. Since the threaded rod is disposed at an angle of 45° with respect to the direction of movement, this gives the fluid jet cutter a longitudinal component equal to that of the speed of the board.

The figure-eight-shaped tank is so designed that it can catch and hold spent fluid from the fluid jet cutter at all positions of the cutter. Additionally, the arcuate portions of the tank are provided to receive spent fluid from the fluid jet cutter when the threaded screw is pivoted from one operative position to a second operative position disposed 90° with respect to the first operative position. This permits the jet cutter fluid stream to be left on at all times during the operation, even when the threaded rod is changed from one position to another. This obviates the need for shutoff valves to be provided in the jet cutter to cut off the fluid when changing from one position to another. It was found that because of the high operating pressure of the fluid, valves used to open and shut the cutting stream do not hold up but become inoperative very quickly in use. The use of the figure-eight-shaped tank permits the cutting stream to be left on at all times during the operation of the apparatus. If desired two slots may be provided in the tank by means of central plates, and two jet cutters may be mounted one over each slot so that operation may be continued even when one of the jet cutters malfunctions.

The crank motor 78, crank shaft assembly 79 and connecting rod 80 are so designed that when it is desired to move the beam and threaded rod from one 45° angle position to the other, the crank shaft assembly 79 rotates 180°, placing the beam and threaded rod in the opposite 45° angle position. The function is controlled by the limit switches 81, 82, 87, 88 and 89.

In placing the apparatus of the present invention in operation, the conveyor system 53 and 54 is set in motion and gypsum board formed and transported by the conveyor. The beam and screw are first in the position labelled A-B. To make a cut across the gypsum board current is applied to the motor 71 and is controlled by the tach-generator 85 and wheel 86 combination. The current is so controlled that the linear speed of the threaded block 67 and fluid cutter 69 is 1.414 times the longitudinal speed of the moving board, since the fluid jet cutter moves at an angle of 45° with respect to the direction of the moving board. As a result the component of movement of the fluid jet cutter in the longitudinal direction of the moving board is equal to that of the moving board. Consequently, a perfectly straight perpendicular cut is made across the board. At the beginning of the cut the jet cutter 69 mounted on the threaded block 67 is at end of the screw labelled "A". As the screw turns the jet cutter moves across the board and makes a straight square cut. The cutter continues moving until the threaded block 67 engages the limiting micro switch 88. Current to the motor 71 is then turned off and current to the motor 78 is applied. This causes the screw and the beam 63 to pivot about the pivot support 68 until the structure assumes the position C-D. At this point the beam engages micro switch 82, turning off the current to the motor 78 and applying current to the motor 67 of a polarity opposite to that applied when the jet cutter travelled from A to B. The jet cutter now travels in the direction from C to D and cuts the moving board from right to left. When the cutter reaches point "D", the micro switch 89 is engaged, turning off current to the motor 67 and applying current to the motor 78 to return the beam and screw assembly to its original position A-B. As a result of the arrangement cuts can be made both from left to right and right to left without turning off the jet stream, since the figure-eight tank is arranged to receive spent fluid at every position of the jet fluid cutter.

The invention is claimed as follows:

1. An apparatus for cutting a newly-formed continuous gypsum board sheet moving along a conveyor into individual gypsum boards, which comprises (a) an elongate frame, (b) a supporting member pivotally mounted at its center vertical axis on said frame, (c) a lead screw rotatably mounted on said supporting member, (d) a power means for pivoting said supporting member and said lead screw through an arc alternately to one of two rest positions obliquely positioned with respect to the direction of movement of said gypsum sheet, (e) a threaded member engaging said lead screw, (f) a high pressure fluid jet cutter mounted on said threaded member having means of engaging the threads of said screw, (g) power means for rotating said lead screw alternatively in one of two directions to cause said jet cutter to travel back and forth along said lead screw, and (h) tank means for receiving the expended fluid from said jet cutter.

2. An apparatus according to claim 1, additionally having tank means for receiving spent jet fluid while said lead screw is rotated about its vertical axis to move said lead screw from one to the other of said operating positions.

3. An apparatus according to claim 2, wherein said tank means is arcuate in form.

4. An apparatus according to claim 2, wherein said tank means comprises two arcuate segments each having a bottom, an outer wall and an inner wall spaced-apart therefrom, and a pair of diametrically disposed tank segments intersecting each other at the centers thereof, each diametrically disposed tank segment comprising a bottom and a pair of spaced-apart walls, the chambers of said arcuate tank segments and said diametrically disposed tank segments communicating with each other, the arrangement being such that the spent fluid from said jet cutter is received by the chambers of said tank segment in all positions of said jet cutter.

* * * * *